US005372054A

United States Patent [19]

Federighi, Sr.

[11] Patent Number: 5,372,054

[45] Date of Patent: Dec. 13, 1994

[54] AUTOMATIC CORK EXTRACTOR

[76] Inventor: George J. Federighi, Sr., 70 - 13th St., San Francisco, Calif. 94103

[21] Appl. No.: 75,722

[22] Filed: Jun. 14, 1993

[51] Int. Cl.[5] ..... B67B 7/44

[52] U.S. Cl. ..... 81/309; 7/156; 81/3.2; 81/3.25; 30/1.5

[58] Field of Search ..... 7/155, 156; 81/3.09, 81/3.2, 3.25, 3.48, 9.4, 9.44; 30/1.5, 165, 301, 102, 112

[56] References Cited

U.S. PATENT DOCUMENTS

| | | | |
|---|---|---|---|
| 2,566,653 | 9/1951 | Callahan et al. | 30/1.5 |
| 2,823,395 | 2/1958 | Brownson | 30/1.5 X |
| 4,574,663 | 3/1986 | Delisle | 81/3.09 X |
| 4,766,780 | 8/1988 | Sechen | 81/3.2 |
| 4,845,844 | 7/1989 | Allen | 30/1.5 |
| 5,079,975 | 1/1992 | Spencer | 81/3.2 |
| 5,095,778 | 3/1992 | Bocsi et al. | 81/3.2 |

FOREIGN PATENT DOCUMENTS

| | | | |
|---|---|---|---|
| 2199813 | 7/1988 | United Kingdom | 81/3.2 |

*Primary Examiner*—James G. Smith
*Attorney, Agent, or Firm*—Harris Zimmerman

[57] ABSTRACT

An apparatus for opening a wine bottle includes a cork seal remover assembly, comprising a housing having a cavity therein, the cavity including opposed side walls that taper downwardly to a bottom opening and converge rearwardly toward a rear wall. A blade assembly is received within the cavity, the blade assembly including a pair of spring arms disposed to impinge resiliently on the side walls of the cavity. The spring arms include arcuate blades in confronting relationship to define a gap therebetween. A bottle neck is inserted between the blades and urged rearwardly, causing the spring arms to converge and the blades to impinge on the seal, severing the end of the seal. The cork remover portion of the invention includes a corkscrew blade disposed coaxially within a tubular housing. The corkscrew blade is operated by a reversible motor, and a sensor within the inner end of the tubular housing is connected to reverse the rotation of the motor and blade. A tubular shuttle is slidably disposed within the housing to accept the upper neck portion of a wine bottle. The shuttle includes an internal stop to limit the insertion depth of the bottle neck, and the tubular housing includes an external stop that limits the translation of the shuttle into the housing. The bottle neck is inserted into the shuttle opening and urged toward the tip of the rotating corkscrew. The corkscrew bores into the cork while also pulling the bottle and shuttle further into the tubular housing. The shuttle encounters the external stop, and the auger effect of the corkscrew pulls the cork from the bottle neck. The cork is withdrawn until the cork strikes the sensor, reversing the motor, the counterclockwise rotation of the corkscrew pushing the cork, bottle, and shuttle distally out of the tubular housing.

13 Claims, 4 Drawing Sheets

AUTOMATIC CORK EXTRACTOR

BACKGROUND OF THE INVENTION

Cork stoppers for sealing the opening of a bottle have been known for many hundreds of years, and devices for removing such stoppers are correspondingly old. The oldest device for removing a cork is the well-known cork screw, a helical wire joined to a handle. The handle is rotated to advance the helix into the soft cork in screw thread fashion, and the tensile force is applied between the handle and the bottle to pull the cork stopper from the bottle opening. Variations on the cork screw device include lever handles or fulcrum links to create a mechanical advantage for pulling the cork stopper from the bottle. In addition, many cork screw assemblies are provided with a blade or similar utensil for cutting and stripping the foil wrap that covers the upper end of the bottle and the exposed end of the cork. The foil wrap is necessary to protect the cork from drying, shrinking, and deteriorating. Due to the fact that the foil is usually composed of lead, it is necessary to remove the foil from the bottle opening to eliminate the potential for contamination of the contents of the bottle by the lead foil as the liquid is poured from the bottle.

Cork screw devices are relatively easy to use, although most such devices require manual exertion and a certain amount of dexterity and time to accomplish the task. In recent years new forms of cork extractors have been developed to reduce the effort involved and simplify the task of cork removal. One such device employs a pair of parallel blades joined to a handle and disposed to be inserted in parallel alignment with the axis of the cork between the cork and the inner surface of the bottle neck. Once the blades are inserted, it is possible to rotate the handle and cork while pulling the handle to effect removal of the cork. This type of device is somewhat easier to use than a cork screw, although manual effort and exertion are required. A further development in the art comprises pressurized cork extractors, which rely on the injection of high pressure fluid or gas into the bottle to create a pressure within the bottle sufficient to force the cork from the bottle opening without manual effort.

The traditional cork screw, as well as the newer devices, are well adapted for use in opening wine bottles in small numbers; i.e., one to several bottles in a brief period of time. However, in a situation in which a large number of bottles must be opened in a relatively brief time, these devices are inefficient, labor intensive, and generally unsuitable for the task. For example, banquets, large restaurants, bar operations, and similar food service businesses require large numbers of wine bottles to be opened in a short amount of time, and time and effort expended in such tasks represent unnecessary expenses. Thus there is a need in the prior art for a device to remove a cork from a bottle opening easily and quickly with a minimum of manual intervention.

SUMMARY OF THE PRESENT INVENTION

The present invention generally comprises an apparatus for automatically opening a wine bottle. A salient feature of the apparatus is that it strips the foil from the bottle end and pulls the cork from the bottle opening, while requiring no manual exertion to accomplish either task. Moreover, the cork is removed quickly and positively, so that a large number of wine bottles may be opened in a short time.

The foil remover assembly of the invention includes a housing having a cavity therein, the cavity including opposed side walls that taper downwardly to a bottom opening and converge rearwardly toward a rear wall. A blade assembly is received within the cavity, the blade assembly including a pair of spring arms disposed to impinge resiliently on the side walls of the cavity. The spring arms support a pair of arcuate blades disposed in confronting relationship to define a gap therebetween. Extending between the rear wall of the cavity and the blade assembly is a compression spring that urges the blade assembly forward toward the widest portion of the cavity, so that the spring arms are spread maximally.

The top of a bottle neck is inserted through a front opening in the housing which guides the bottle neck into the gap between the blades. As the bottle is urged rearwardly, the blade assembly is likewise urged rearwardly against the spring force, causing the spring arms to converge and the confronting blades to impinge on the foil covering of the top of the bottle neck. The bottle is rotated manually, causing the blades to cut through the foil, which drops through the bottom opening. As the bottle is withdrawn from the front opening of the device, the spring arms diverge once again.

The cork remover portion of the invention includes a tubular housing, and a corkscrew blade disposed coaxially within the housing. The corkscrew blade is operated by a reversible motor, and a sensor within the inner end of the tubular housing is connected to reverse the rotation of the motor and blade. A tubular shuttle is slidably disposed within the housing, and is dimensioned to accept the upper neck portion of a wine bottle. The shuttle includes an internal stop to limit the insertion depth of the bottle neck. Likewise, the tubular housing includes an external stop that limits the translation of the shuttle into the housing.

The motor is started to rotate the corkscrew clockwise, and the bottle neck (previously stripped of the foil cover) is inserted into the shuttle opening and urged toward the tip of the corkscrew. The corkscrew engages the cork, and bores into the cork while also pulling the bottle and shuttle further into the tubular housing. When the shuttle encounters the external stop and is blocked from further translation, the continued rotation of the corkscrew causes an auger effect that begins to pull the cork from the bottle neck. The cork is withdrawn from the bottle neck until the cork impinges on the sensor at the inner end of the tubular housing. Actuation of the sensor stops and reverses the motor, and the counterclockwise rotation of the corkscrew pushes the cork, bottle, and shuttle distally toward the distal opening of the tubular housing. The bottle is then removed from the tubular housing. Proper positioning of the internal stop of the shuttle and the external stop of the tubular housing with respect to the length of the corkscrew blade and sensor position permits the cork to be withdrawn almost completely, so that final removal of the cork may be performed manually with ease at the time and location of service to the consumer.

The entire procedure requires only a few seconds, with no manual effort exerted. Thus many bottles may be opened easily in a short time. It should be noted that the cork remaining in the bottle guarantees to the consumer that the bottle has not been tampered with or the contents altered, and the ritual of smelling the cork and tasting the freshly opened bottle is not hampered.

DESCRIPTION OF THE PREFERRED EMBODIMENT

Figure 1:
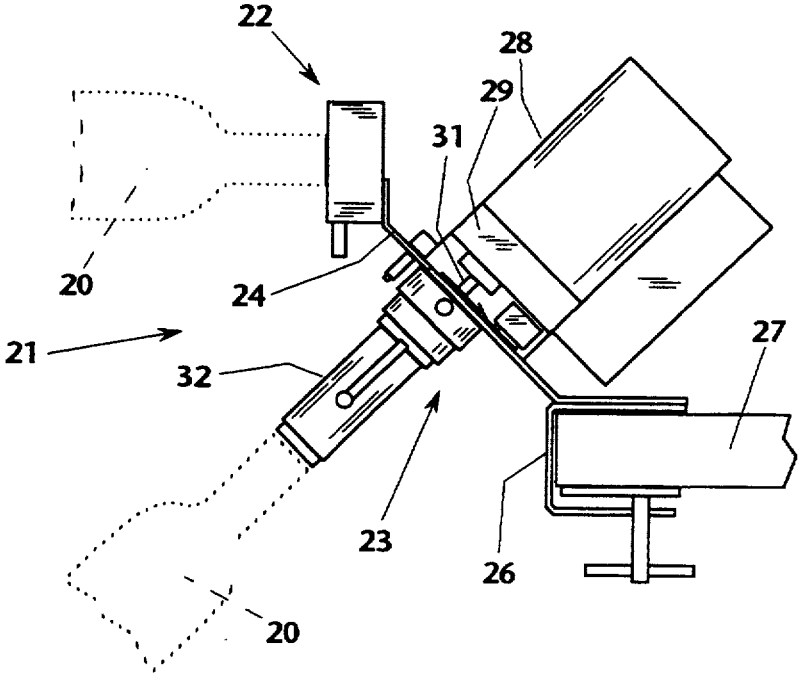
FIG. 1 is a plan view of the apparatus of the invention for stripping the foil seal and removing the cork from a corked bottle.
Figure 2:
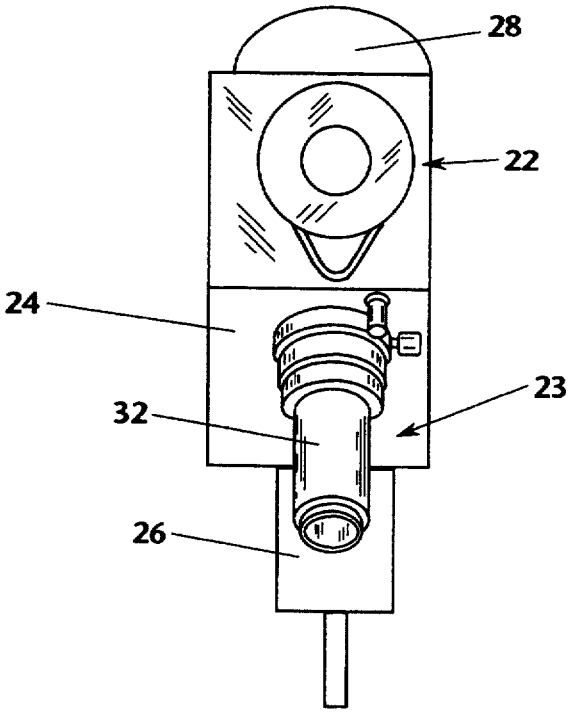
FIG. 2 is a front elevation of the apparatus as shown in FIG. 1.

The present invention generally comprises an apparatus for automatically opening a wine bottle. With regard to FIGS. 1–4, the apparatus 21 generally includes an assembly 22 for stripping the seal from the end of a corked wine bottle 20. The seal is typically fashioned of lead foil, but other metal foils, plastic, and paper may also be used and may be treated by the assembly 22. The apparatus further includes an assembly 23 for withdrawing the cork from the neck of the bottle. A panel frame member 24 supports both assemblies 22 and 23, and it is secured in turn to a clamping bracket 26 that is secured to a rigid supporting member 27. Any equivalent bracket may be used to secure the apparatus 21 to a table, counter, wall, or support base.

The cork remover assembly 23 includes a reversible motor 28 coupled directly to a gear reduction unit 29 which is secured to the frame 24. The output shaft 31 of the gear reduction unit is joined directly to a corkscrew bit 30, which extends distally a fixed distance through a hole in the frame 24. A tubular housing assembly 32 extends distally from the frame 24 in concentric fashion about the corkscrew bit 30.

Figure 3:
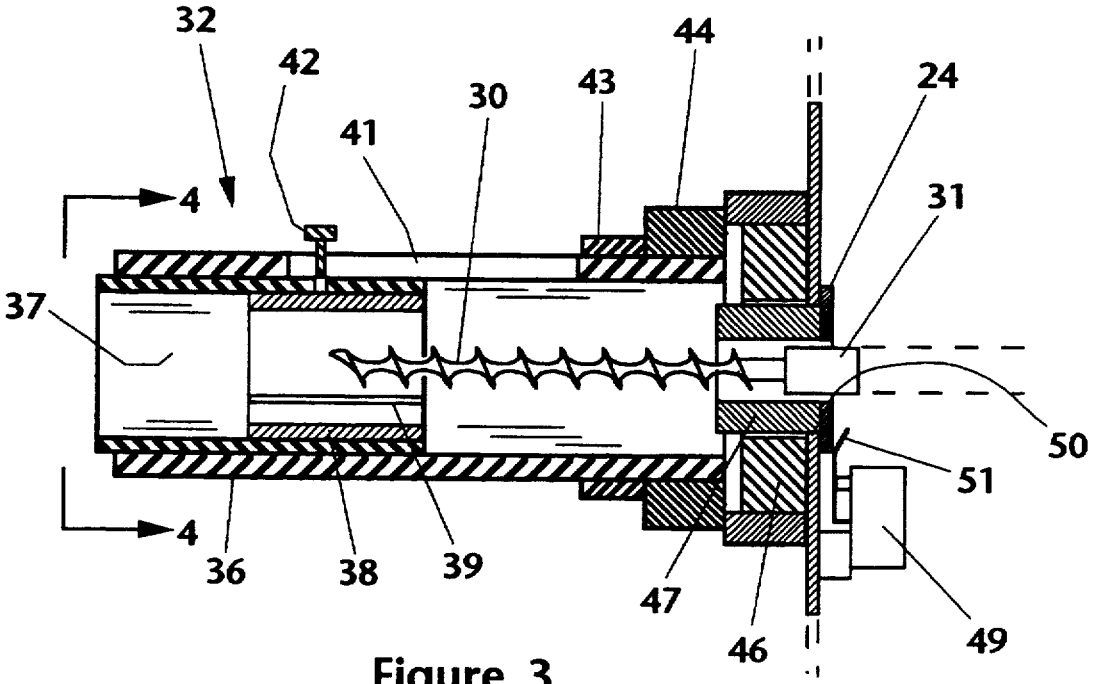
FIG. 3 is an enlarged cross-sectional view of the tubular housing assembly of the apparatus of the invention.
Figure 4:
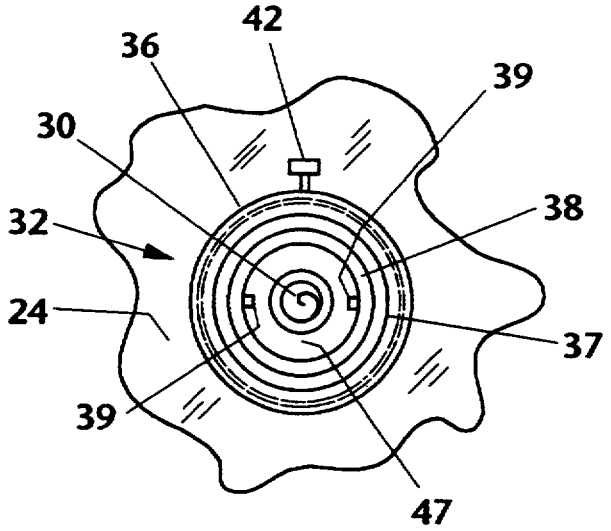
FIG. 4 is an enlarged front view of the tubular housing assembly, taken along line 4—4 of FIG. 3.

With regard to FIGS. 3 and 4, the tubular housing assembly 32 includes an outer tube 36, and a tubular shuttle 37 disposed in freely translating fashion within the distal end portion of the tube 36. The distal end of the shuttle 37 is sufficient in diameter to receive a typical wine bottle neck with clearance. A tubular liner 38 within the proximal end of the shuttle 37 is too small in diameter to permit passage of a typical wine bottle neck, and comprises a shuttle stop, as will be explained in detail in the following description. A pair of longitudinally extending ribs 39 are joined to the inner surface of the liner 38 in diametrically opposed fashion, for purposes to be described in the following specification. The outer tube 36 is provided with a longitudinally extending slot 41 in a medial portion of the sidewall thereof, and a set screw 42 extends from a tapped hole in the shuttle 37 through the slot 41. The set screw translates within the closed slot 41 and limits the travel of the shuttle both proximally and distally.

At the proximal end of the tube 36, a ring 43 secures and supports a collar 44 extending proximally toward the supporting panel frame 24. A bushing 46 is secured to the frame 24, and the collar 44 is dimensioned to engage the bushing rigid fashion to support the tubular assembly 32 on the frame 24. The frame 24 includes an opening 50 through which the corkscrew bit 30 extends axially with respect to the tubular assembly 32. A tubular sensor 47 extends through the hole 50 concentrically about the shaft 31 and corkscrew bit 30, the sensor 47 being dimensioned for free axial translation in the hole 50. Secured to the proximal side of the plate 24 is a microswitch 49 having a switch leaf 51 extending therefrom to impinge on the proximal end of the sensor 47. In the quiescent position depicted in FIG. 3, the switch 49 is normally open.

Figure 5:
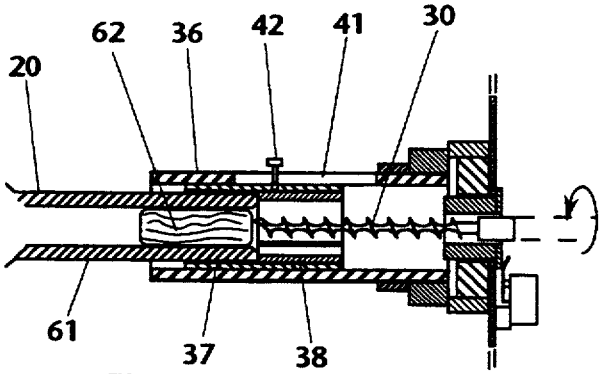
FIG. 5–FIG. 8 are a sequence of cross-sectional views of the tubular housing assembly showing the operation of the cork remover apparatus.
Figure 6:
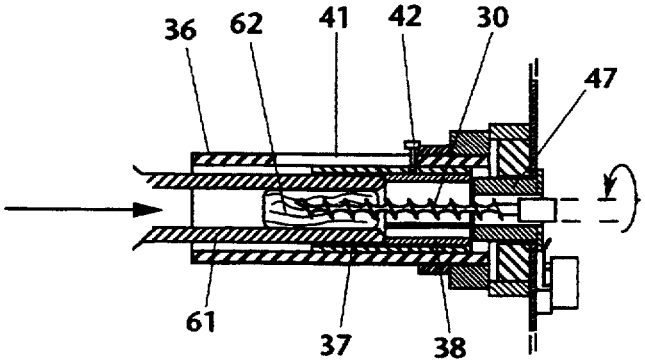

The operation of the cork remover assembly is depicted sequentially in FIGS. 5–8. The motor 28 is switched on to rotate clockwise. The bottle 20 is gripped manually and the upper neck portion 61 of the bottle is inserted into the distal end of the shuttle 37 until the end of the bottle impinges on the internal stop formed by the sleeve 38, as shown in FIG. 5. The distal tip of the corkscrew blade 30 impinges on the outer surface of the cork 62, and begins to thread itself into the cork. The auger action of the corkscrew blade 30 pulls the cork 62 and the bottle neck 61 further into the outer tube 36, urging the shuttle proximally in the tube 36. The shuttle translates proximally until the set screw 42 impinges on the proximal end of the slot 41, causing the shuttle to cease translation, as shown in FIG. 6. At this point the corkscrew blade is well engaged in the cork. Thereafter, the auger action of continued rotation of the corkscrew blade 30 begins to pull the cork from the neck 61. The peripheral surface of the cork is engaged by the ribs 39 to resist rotation of the cork with respect to the bottle and the apparatus.

Figure 7:
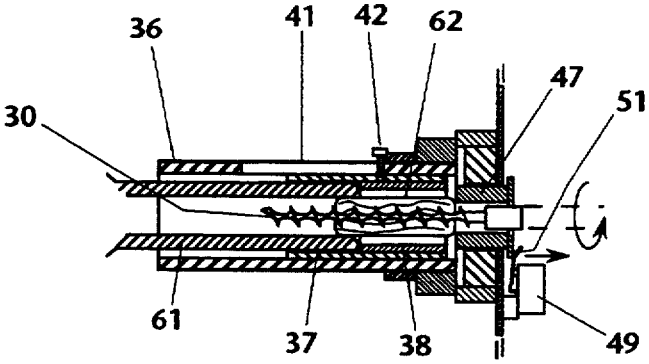
Figure 8:
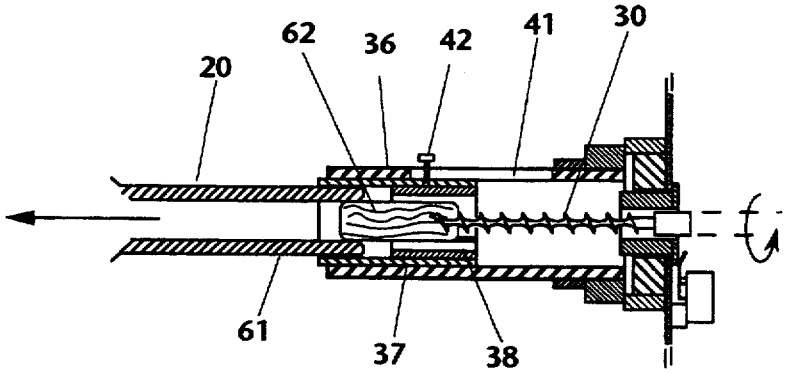

The cork 62 is withdrawn from the bottle and advances proximally until the outer end of the cork impinges on the sensor 47. At this point a large proportion of the length of the cork has been withdrawn from the bottle, but a small proportion remains in the bottle opening. When the sensor 47 is driven proximally by the cork, the sensor trips the switch leaf 51 and actuates the switch 49 to stop and reverse the motor 28, as depicted in FIG. 7. The reverse auger action of the corkscrew blade 30 rotating counterclockwise urges the cork 62 distally. The portion of the cork withdrawn from the bottle neck tends to expand radially, and does not reenter the bottle opening. Due to the fact that the bottle is not constrained in distal movement, the cork urges the bottle distally, discharging the bottle neck 61 from the tube 36 with the cork lodged in the bottle opening and ready to be pulled from the opening by a quick manual gesture. Thereafter the motor is stopped, the procedure is completed, and the apparatus is ready for another cork removal procedure.

It may be appreciated that the position of the set screw 42 must be properly positioned with respect to the proximal extent of the slot 41 and with the lengths of the shuttle 37 and the liner 38, as well as the length of the corkscrew blade 30. These parameters may be set so that the cork 62 is removed to any desired extent including complete removal if desired. However, it is preferable for the cork to remain lodged in the bottle opening, so that the consumer may know that the bottle is being opened as it is served. The shuttle 37 may be provided with a plurality of tapped holes arrayed along the length of the shuttle, so that the apparatus may be adjusted for bottles having differing cork length.

Figure 9:
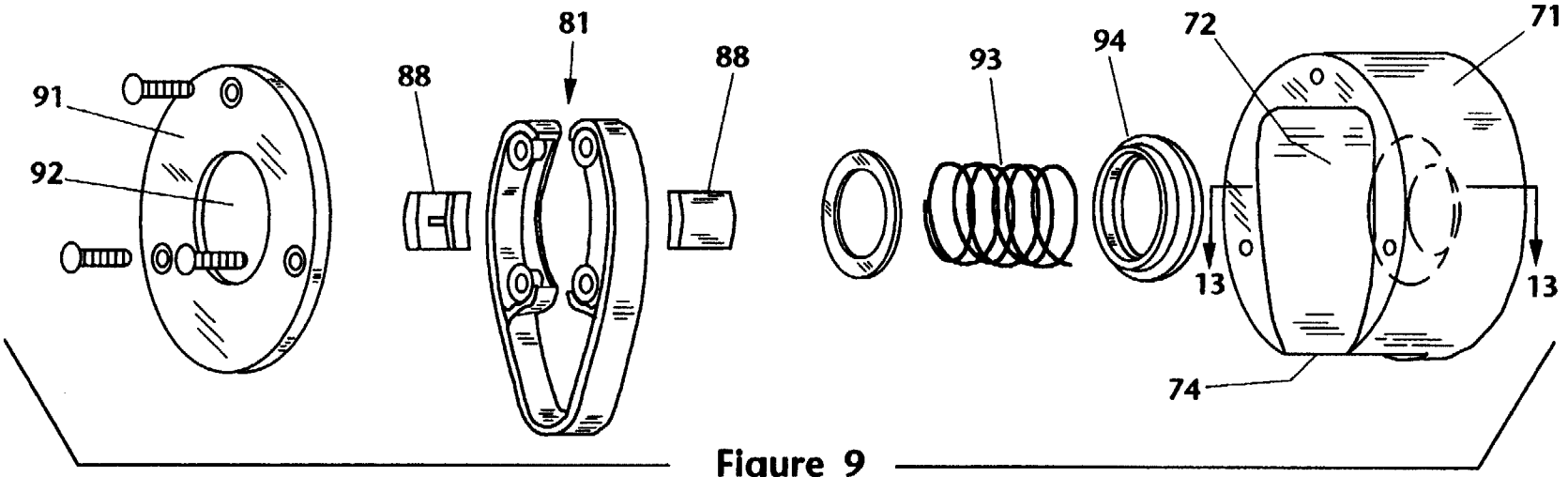
FIG. 9 is an exploded view of the foil seal remover apparatus of the invention.
Figure 13:
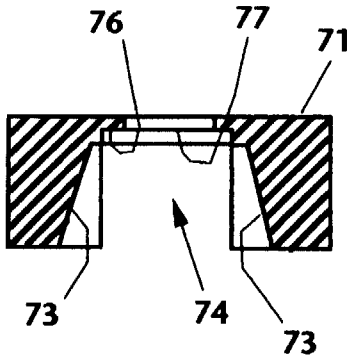
FIG. 13 is a cross-sectional view of the housing of the foil seal remover apparatus, taken along line 13—13 of FIG. 9.

Prior to withdrawal of the cork, the seal that is typically provided to cover the outer end of the cork must be removed to prevent contamination of the wine and interference with the corkscrew blade. With regard to FIG. 9, the seal remover assembly 22 includes a generally cylindrical housing 71 (FIG. 13) having a cavity 72 formed therein. The cavity 72 includes opposed side walls 73 that converge toward the rear wall 76 of the cavity, and also taper downwardly toward a bottom opening 74. A cylindrical socket 77 is also formed in the rear wall 76.

Figure 12:
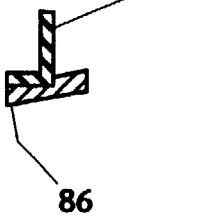
FIG. 12 is an enlarged cross-sectional view of the blade of the foil seal remover apparatus, taken along line 12—12 of FIG. 11.
Figure 11:
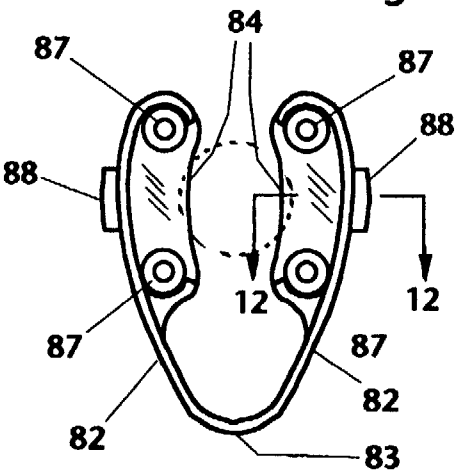
FIG. 11 is a plan view of the spring arm-blade assembly of the foil seal remover apparatus.
Figure 10:
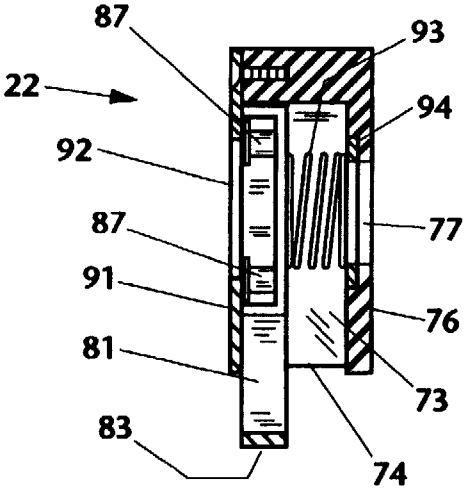
FIG. 10 is a cross-sectional elevation of the foil seal remover apparatus of the invention.

The seal remover assembly further includes a blade assembly 81 (FIG. 11) that is secured within the cavity 72. The blade assembly 81 consists of a pair of spring arms 82 extending from a common vertex 83 in a heart-shaped configuration, the spring arms supporting a pair of arcuate blades 84 in confronting, spaced apart relationship. As shown in FIG. 12, each blade 84 includes a knife edge 86 capable of cutting the cork seal. Each blade further includes a pair of tubular standoffs 87 spaced apart a small distance from their respective knife edges. Secured to opposed surfaces of the spring arms are a pair of shoes 88.

The blade assembly 81 is retained within the cavity 72 by a plate 91 secured to the front surface of the housing 71. The plate 91 includes a central opening 92 that is dimensioned to accept a wine bottle neck 61, and is aligned centrally with respect to the blades 84 and the standoffs 87. The shoes 88 secured to the spring arms 82 impinge in slidable fashion on the opposed side walls 73 of the cavity 72, so that insertion of a bottle neck through the opening 92 between the spring arms of the blade assembly causes translation of the spring arm assembly rearwardly toward the rear wall 77. The rearward movement of the blade assembly is opposed by a compression spring 93 extending between the spring arm assembly and a spring keeper 94 received in the socket 77.

The converging side walls 73 cause the rearwardly translating spring arms to converge toward the bottle neck 61, driving the knife edges 86 into the foil seal and cutting through the seal. The standoffs 87 limit the depth of penetration of the knife edges into the seal, so that the bottle neck is not damaged. The bottle may be turned manually about its longitudinal axis through a partial rotation to sever the foil seal completely about bottle neck, and the bottle neck is then withdrawn from the opening 92. As the bottle is withdrawn, the blade assembly is urged forwardly by the spring 93, and the resilient restoring force of the spring arms 82 cause the blades 84 to diverge and release the bottle neck. The cut end portion of the foil seal falls away from the bottle as the bottle is removed from the opening 92, and the bottle is thus prepared to be opened by the assembly 23, as explained previously.

I claim:

1. An apparatus for opening a bottle having a neck and a cork closure secured in the neck, including a corkscrew blade;

a tubular passage having a distal end adapted to receive the neck portion of a corked bottle and an opposed proximal end, said corkscrew blade extending axially into said passage from said proximal end of said tubular passage;

motor means for rotating said corkscrew blade in a first direction to drive said corkscrew blade into the cork and exert a force proximally on said cork to pull the bottle neck proximally into said tubular passage;

stop means for limiting proximal movement of the bottle neck in said tubular passage, whereby said corkscrew blade pulls the cork from the bottle neck;

sensor means disposed at a proximal end portion of said tubular passage to be actuated by the cork pulled from the bottle neck, said sensor means connected to reverse said motor means and rotate said corkscrew in a second direction, whereby said corkscrew blade drives said cork and bottle neck distally from said tubular passage.

2. The apparatus of claim 1, wherein said stop means includes a tubular shuttle disposed in freely translating fashion in said tubular passage, said tubular shuttle having a distal end opening sufficient in diameter to receive the bottle neck.

3. The apparatus of claim 2, wherein said tubular shuttle includes an internal stop to limit proximal translation of the bottle neck into the tubular shuttle.

4. The apparatus of claim 3, further including external stop means operatively connected between said tubular passage and said tubular shuttle for limiting proximal movement of said tubular shuttle in said tubular passage.

5. The apparatus of claim 2, wherein said tubular shuttle includes means for engaging the cork to resist rotation of the cork by said corkscrew blade as the cork is withdrawn from the bottle neck.

6. An apparatus for opening a bottle having a neck and a cork closure with a seal secured at the neck, including;

a seal remover assembly and a cork remover assembly supported conjointly, said seal remover assembly including a housing having a cavity therein, said cavity including opposed side walls that converge toward a rear wall and taper inwardly toward a bottom opening;

blade assembly means, including a pair of spring arms, a pair of blades supported by said spring arms in confronting, spaced apart relationship, said spring arms impinging resiliently on said opposed side walls of said cavity:

means for guiding insertion of said bottle neck between said pair of blades to engage and urge said blades rearwardly, whereby said spring arms engage said side walls and are driven together to urge said blades to cut through the seal of the bottle neck;

said cork remover assembly including;

a corkscrew blade;

a tubular passage having a distal end adapted to receive the neck portion of a corked bottle, said corkscrew blade extending axially from a proximal end of said tubular passage;

motor means for rotating said corkscrew blade in a first direction to drive said corkscrew blade into the cork and exert a force proximally on said cork to pull the bottle neck proximally into said tubular passage;

stop means for limiting proximal movement of the bottle neck in said tubular passage, whereby said corkscrew blade pulls the cork from the bottle neck;

sensor means disposed at a proximal end portion of said tubular passage to be actuated by the cork pulled from the bottle neck, said sensor means connected to reverse said motor means and rotate said corkscrew in a second direction, whereby said corkscrew blade drives said cork and bottle neck distally from said tubular passage.

7. The apparatus of claim 6, wherein said seal remover assembly further includes compression spring means for urging said blade assembly in a forward direction away from said rear wall of said cavity and toward the diverging portions of said side walls, whereby said spring arms are maximally diverged within said cavity 8. The apparatus of claim 7, wherein said blade assembly includes a plurality of standoffs disposed adjacent to the respective cutting edges of said blades to limit the depth of penetration of said cutting edges in the seal.

9. The apparatus of claim 7, wherein said blade assembly includes a pair of shoes disposed between a respective spring arm and a respective side wall to slidably translate said blade assembly along said side walls.

10. The apparatus of claim 9, wherein said housing includes front opening mean for said cavity, said front opening means being generally aligned to guide the bottle neck between said confronting, spaced apart blades.

11. An apparatus for removing the outer end portion of a seal secured over the end of a bottle neck having a cork closure, including;

a housing having a cavity therein, said cavity including opposed side walls that converge toward a rear wall and taper inwardly toward a bottom opening;

blade assembly means, including a pair of spring arms, a pair of blades supported by said spring arms in confronting, spaced apart relationship, said spring arms impinging resiliently on said opposed, converging side walls of said cavity and disposed to translate along said opposed, converging side walls;

means for guiding insertion of said bottle neck between said pair of blades to engage and urge said blades rearwardly, whereby said spring arms translate along said converging side walls toward said rear wall and are driven together to urge said blades to cut through the seal of the bottle neck;

said seal remover assembly including compression spring means for urging said blade assembly in a forward direction away from said rear wall of said cavity and toward the diverging portions of said side walls, whereby said spring arms are maximally diverged within said cavity;

said blade assembly including a pair of shoes, each disposed between a respective spring arm and a respective side wall to slidably translate said blade assembly along said side walls.

12. The apparatus of claim 11, wherein said blade assembly includes a plurality of standoffs disposed adjacent to the respective cutting edges of said blades to limit the depth of penetration of said cutting edges in the seal.

13. The apparatus of claim 11, wherein said means for guiding insertion of the bottle neck includes front opening mean for said cavity, said front opening means being generally aligned to guide the bottle neck between said confronting, spaced apart blades.

* * * * *